US009059489B2

(12) United States Patent
Lamour et al.

(10) Patent No.: US 9,059,489 B2
(45) Date of Patent: Jun. 16, 2015

(54) BALANCED FEED BUSHING DEVICE FOR ANTENNAS

(75) Inventors: Frédéric Lamour, Colombes (FR); Alain Eberland, Colombes Cedex (FR); Alain Denechaud, Colombes Cedex (FR)

(73) Assignee: THALES, Courbevoie (FR)

( * ) Notice: Subject to any disclaimer, the term of this patent is extended or adjusted under 35 U.S.C. 154(b) by 269 days.

(21) Appl. No.: 13/517,012

(22) PCT Filed: Dec. 16, 2010

(86) PCT No.: PCT/EP2010/069956

§ 371 (c)(1),
(2), (4) Date: Nov. 2, 2012

(87) PCT Pub. No.: WO2011/073338

PCT Pub. Date: Jun. 23, 2011

(65) Prior Publication Data

US 2013/0147571 A1 Jun. 13, 2013

(30) Foreign Application Priority Data

Dec. 18, 2009 (FR) ..... 09 06180

(51) Int. Cl.

| | |
|---|---|
| ***H01Q 1/00*** | (2006.01) |
| ***H01P 3/02*** | (2006.01) |
| ***H01P 3/04*** | (2006.01) |
| ***H01Q 1/04*** | (2006.01) |
| ***H01Q 1/46*** | (2006.01) |

(52) U.S. Cl.
CPC .. *H01P 3/02* (2013.01); *H01P 3/04* (2013.01); *H01Q 1/04* (2013.01); *H01Q 1/46* (2013.01)

(58) Field of Classification Search
CPC ..... H01Q 1/46; H01Q 1/04; H01P 3/04; H01P 3/02
See application file for complete search history.

(56) References Cited

U.S. PATENT DOCUMENTS

| | | | | |
|---|---|---|---|---|
| 1,744,092 A | | 1/1930 | Wrape | |
| 2,466,183 A | * | 4/1949 | Reed | 423/229 |
| 4,697,191 A | | 9/1987 | Cross | |
| 5,155,495 A | * | 10/1992 | Hately et al. | 343/725 |
| 5,446,473 A | * | 8/1995 | Nielsen | 343/890 |

FOREIGN PATENT DOCUMENTS

| | | |
|---|---|---|
| EP | 0435585 A2 | 7/1991 |
| FR | 901602 A | 8/1945 |
| FR | 1287548 A | 3/1962 |
| GB | 928712 A | 6/1963 |

* cited by examiner

*Primary Examiner* — Trinh Dinh
(74) *Attorney, Agent, or Firm* — Baker & Hostetler LLP

(57) ABSTRACT

An HF feed bushing device is provided that is designed to connect an HF transmitter/receiver to an antenna via an external medium by means of a balanced two-wire line. The balanced two-wire line is at least partially encapsulated in a central part of a closed conduit including a wall isolating the balanced two-wire line from the external medium. Applications: Feeding of antennas via balanced two-wire lines.

5 Claims, 5 Drawing Sheets

BALANCED FEED BUSHING DEVICE FOR ANTENNAS

CROSS-REFERENCE TO RELATED APPLICATIONS

This application is a National Stage of International patent application PCT/EP2010/069956, filed on Dec. 16, 2010, which claims priority to foreign French patent application No. FR 0906180, filed on Dec. 18, 2009, the disclosures of which are incorporated by reference in their entirety.

FIELD OF THE INVENTION

The invention concerns the feeding of HF telecommunication antennas and in particular a feed bushing device for antennas.

BACKGROUND

Telecommunication systems usually include transmitters/receivers that have to be connected to antennas to radiate and/or to receive an electromagnetic signal.

The RF connection between the transmitter/receiver and the antenna is made by an RF feed line that may be either of balanced type (for example in the most general case a coaxial cable) or of balanced type (most often a balanced two-wire line).

FIG. 1 shows an example of a prior balanced two-wire line including two electrical conductors 10, 12 insulated by respective sheaths 14, 16. The two electrical conductors are kept at a constant distance D from each other by an insulative wall 18 (or insulative spreaders) fastened to the sheaths of the conductors. The insulative wall 18 and the sheaths 14, 16 of the conductors are flexible so as to be able to bend the two-wire line during its installation. The various parameters of the line, notably the diameter of the conductors, the distance D between conductors, the thickness and the dielectric characteristics of the sheath and the spreaders, determine a given characteristic impedance Zc of the feed line.

Balanced two-wire lines have the advantage over unbalanced coaxial lines of having lower transmission losses per unit length and high characteristic impedances. Balanced two-wire lines have known and proven characteristics and properties in a gas, solid or hybrid medium the radio-frequency characteristics of which are very similar to those of air (relative dielectric and magnetic permitivity very close to 1), but nevertheless significantly modified by the presence of an environment near the line having a dielectric permitivity different from that of air, notably when that environment is moist or of a metallic nature.

In some configurations for feeding an HF antenna by a transmitter/receiver relatively far from the antenna the balanced two-wire line must be away from the ground to prevent modifications of its radio-frequency characteristics, which would lead to high losses through mismatching of the antenna with the transmitter or coupling with the ground.

FIG. 2 represents an HF transmitter/receiver feeding an antenna via an overhead balanced two-wire line.

In the FIG. 2 configuration, a transmitter/receiver 22 is in a semi-enclosed place 24 feeding, via a two-wire line 26, an antenna 28 outside that place and at a great distance from that place. The two-wire feed line 26 is held at a distance from the ground 30 by supports 32 fixed to the ground and at least the head of which supporting the two-wire line is in insulative material.

This type of overhead solution represented in FIG. 2 is not desirable for reasons of discretion in the case of military installations. On the other hand, the two-wire line 26 in FIG. 2 cannot be buried without seriously degrading its characteristics, leading to high HF signal transmission losses. This deterioration is mainly caused by the state and the nature of the backfilling soil which significantly modifies the characteristics of the line, possibly being moist and thus more or less conductive. The state of the soil may also vary as a function of prevailing climatic conditions.

SUMMARY OF THE INVENTION

To alleviate the drawbacks of the prior art balanced two-wire antenna feeds, the invention proposes an HF feed bushing device designed to connect an HF transmitter/receiver to an antenna via an external medium by means of a balanced two-wire line, the balanced two-wire line being at least partially encapsulated in a central part of a closed conduit including a wall isolating the balanced two-wire line from the external medium, the wall separating the external medium from an internal medium in the closed conduit having dielectric and magnetic permittivity close to that of air.

The balanced two-wire line is held in the central part of the conduit by insulative material spreaders disposed along the two-wire line, the distance of the two-wire line away from the wall of the conduit and the shape of the spreaders being determined on the basis of parameters such as the maximum voltage and current that the two-wire line can withstand, the maximum allowed variation of the characteristic impedance of said two-wire line, the mechanical stresses induced by the required curvature.

In one embodiment the closed conduit has two ends and at each of the ends an insulative material cap for closing the conduit to isolate the internal medium from the external medium.

In another embodiment the conduit is a flexible and watertight material pipe of circular section to provide flexibility and isolation between the external medium and the internal medium.

In another embodiment the spreaders are held in position in the flexible pipe by flexible insulative material separators around the balanced two-wire line, a separator being disposed between two consecutive spreaders to absorb the stresses on the spreaders on curvature of the pipe.

In another embodiment the pipe includes a metal reinforcing armature in its wall.

In another embodiment the metal reinforcing armature is a metal wire wound helically along the wall of the pipe to preserve the flexibility properties of the bushing.

In another embodiment the wall of the pipe is metallized in order to prevent any external radio-frequency influence on the two-wire line.

BRIEF DESCRIPTION OF THE DRAWINGS

The invention will be better understood with the aid of an embodiment of an antenna feed through-lead device of the invention described with reference to the appended drawings, in which.

DETAILED DESCRIPTION

Figure 3A:
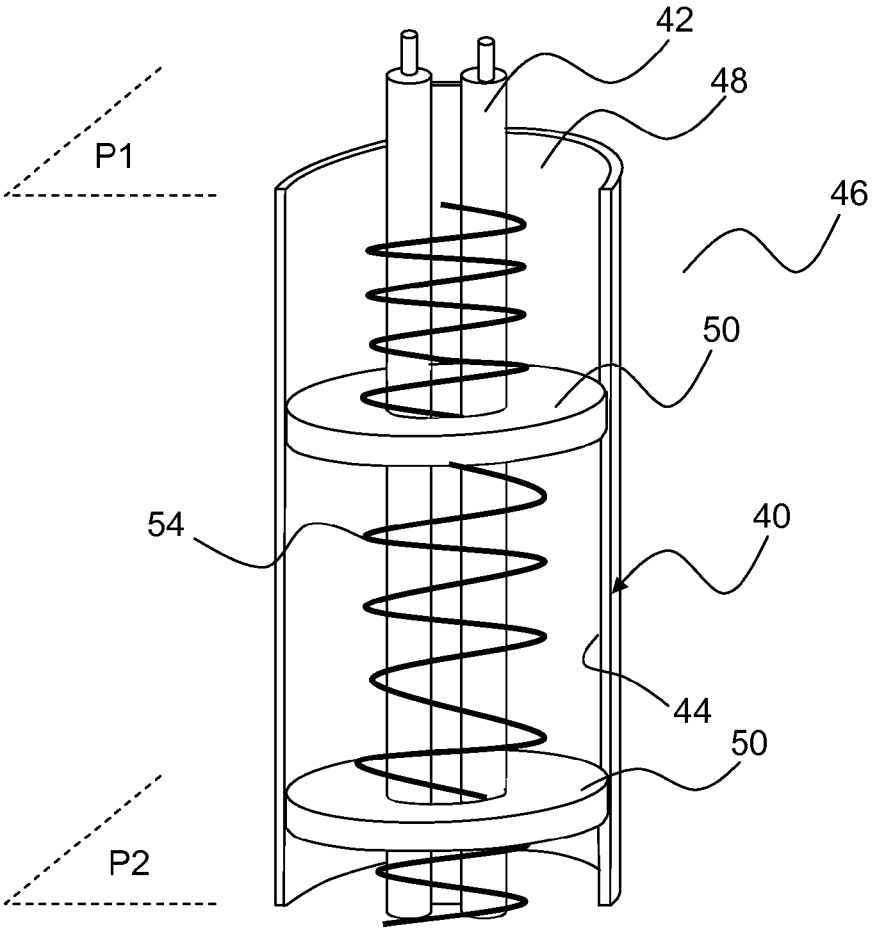
FIG. 3*a* is a partial view of the feed bushing device of the invention.
Figure 3B:
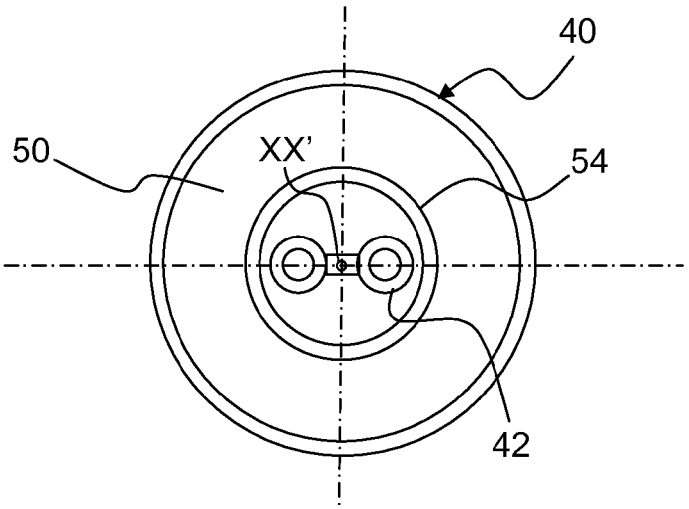
FIG. 3*b* is a plan view of the feed bushing device from FIG. 3*b*.

FIG. 3*a* is a partial view of the feed bushing device of the invention and FIG. 3*b* is a plan view of the feed bushing device from FIG. 3*b*.

Figure 1:
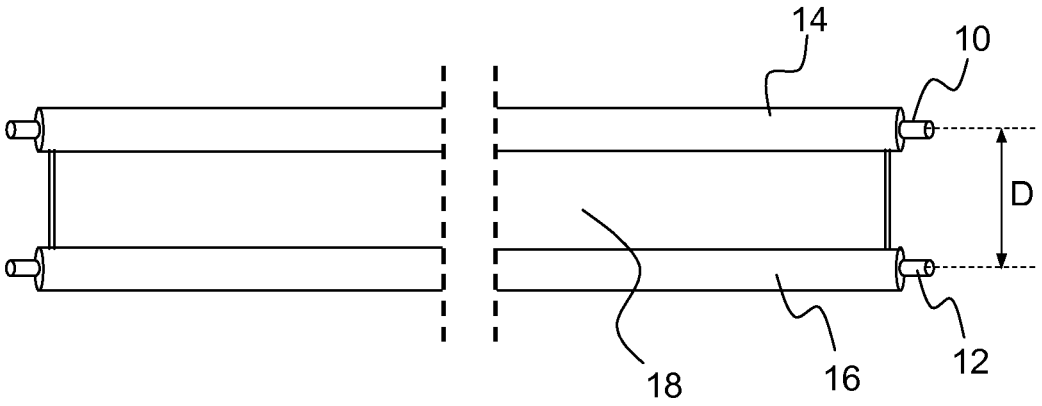
FIG. 1, already described, shows a prior art two-wire line.
Figure 2:
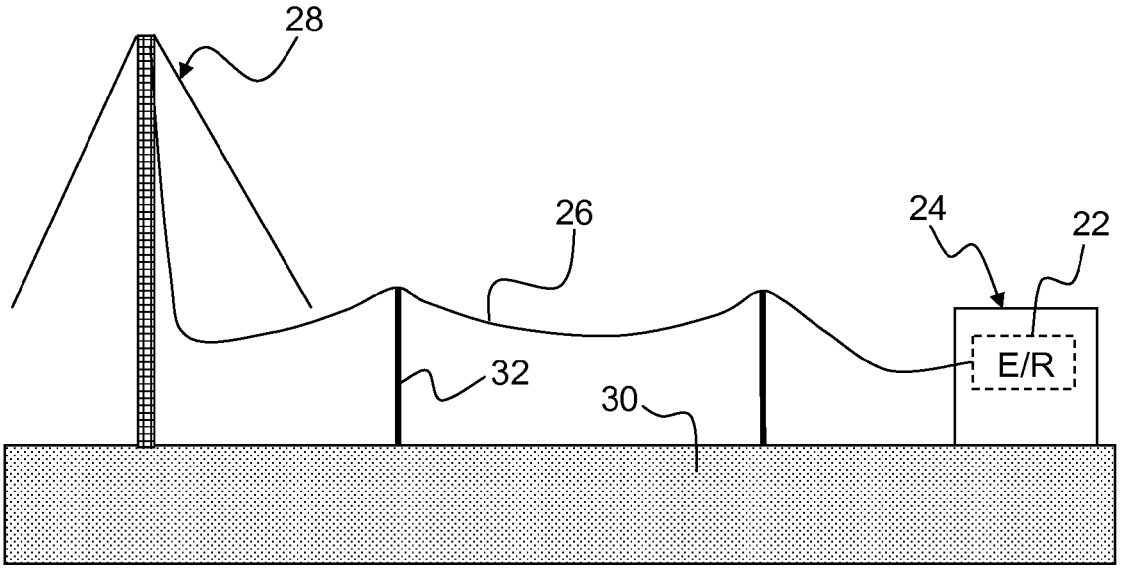
FIG. 2 represents an HF transmitter/receiver feeding an antenna via an overhead balanced two-wire line.

FIG. 3*a* is a partial view in longitudinal section between two planes P1, P2 of a feed bushing device of the invention. In this embodiment, the bushing device includes a pipe 40 of circular section about an axis of revolution XX' (in a straight portion of the pipe) and a balanced two-wire line 42 (as represented in FIG. 1) encapsulated in a central part of the pipe 40 on the axis XX'.

The flexible material pipe 40 includes a separating wall 44 between a medium 46 external to the pipe and an interior medium 48 the dielectric and magnetic permitivity of which are close to that of air. This interior medium 48 is constituted for the most part of air in the present example but it may equally be constituted of any gas or solid or mixture thereof offering a dielectric and magnetic permitivity very close to that of air.

The two-wire line 42 is held in the central part of the pipe by insulative material spreaders 50 in the form of circular rings normal to the axis of the pipe, regularly distributed over all of the length of the pipe. The spreaders ensure a constant distance along the pipe between the two-wire line and the wall 44 of the pipe.

The physical dimensions of the spreaders (among others, the thickness of the spreaders) are chosen to comply with, on the one hand, mechanical constraints, by virtue of a choice between a maximum thickness to withstand the stresses of bending the feed bushing and a minimum thickness for the retention of the two-wire line at the center of the pipe and, on the other hand, the radio-frequency characteristics by virtue of a choice of a maximum thickness and a distribution of the spreaders along the pipe so as not to modify the properties of the two-wire line too significantly.

The shape of the spreaders is also defined on the basis of parameters such as the maximum voltage and current that the two-wire line can withstand, the breakdown voltage between the two-wire line and the wall of the pipe if it is of metal, or the nature of the exterior environment, the maximum allowed variation of the characteristic impedance of said two-wire line, the mechanical stresses induced by the required radius of curvature.

The spreaders 50 are held in place inside the pipe 40 by insulative material separators 54 around the two-wire line 42.

The separators 54 absorb the stresses of movement of the spreaders 50 when the pipe 40 is strongly curved. The separators 54 represented in FIG. 3*a* are helical insulative material spirals around the two-wire line 42. The materials and the shape of the spirals are chosen to ensure, on the one hand, mechanical properties such as the elastic spring property when the feed bushing is curved and, on the other hand, the radio-frequency properties which, by virtue of their presence in the pipe 40, produce only acceptable modifications of the characteristics of the two-wire line 42.

The wall 44 of the pipe 40 may be metallized in order to guarantee any influence on the two-wire line 42 of an external medium of a metallic or moist kind and to isolate the line at radio frequencies.

The watertightness of the feed bushing device is completed by closure of the pipe 40 at each of its two ends by an insulative closure cap, for example, in composite material of epoxy type that ensures good resistance to mechanical and environment stresses.

Figure 4A:
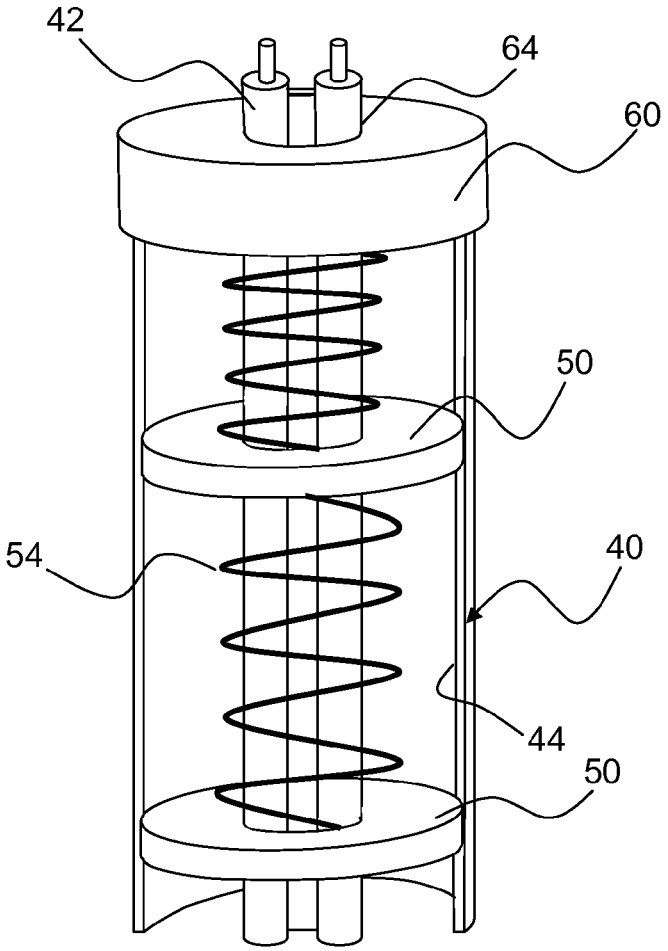
FIG. 4*a* shows one of the ends of the feed bushing device from FIGS. 3*a* and 3*b*.

FIG. 4*a* shows one of the ends of the feed bushing device from FIGS. 3*a* and 3*b* including a cylindrical closure cap 60 including an opening 64 at its center for the watertight passage of the two-wire line 42 for the connection to other balanced two-wire lines or to HF equipment having balanced two-wire type ports.

The closure cap 60 closes the ends of the pipe 40 in watertight fashion to ensure total separation of the interior medium 46 of the feed bushing device relative to the exterior medium 48. To this end, the cap is for example stuck to the end of the pipe and to the two-wire line where it passes through the opening 64 in the cap.

Figure 4B:
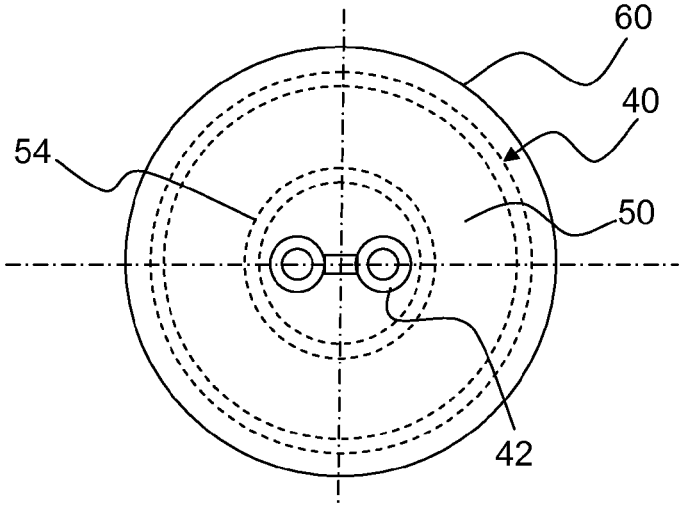
FIG. 4*b* is a plan view of the end of the feed bushing device from FIG. 4*a*.

FIG. 4*b* is a plan view of the end of the feed bushing device from FIG. 4*a*.

In the usual conditions of use of the feed bushing device of the invention, for example in the case of use of the feed bushing device along a wall or simply on the ground, the crushing force exerted on the pipe remains low. In other cases of use, for example, if the feed bushing device must be buried or resist reduced pressure stresses caused by altitude, the pipe must have an increased resistance to crushing.

Figure 5:
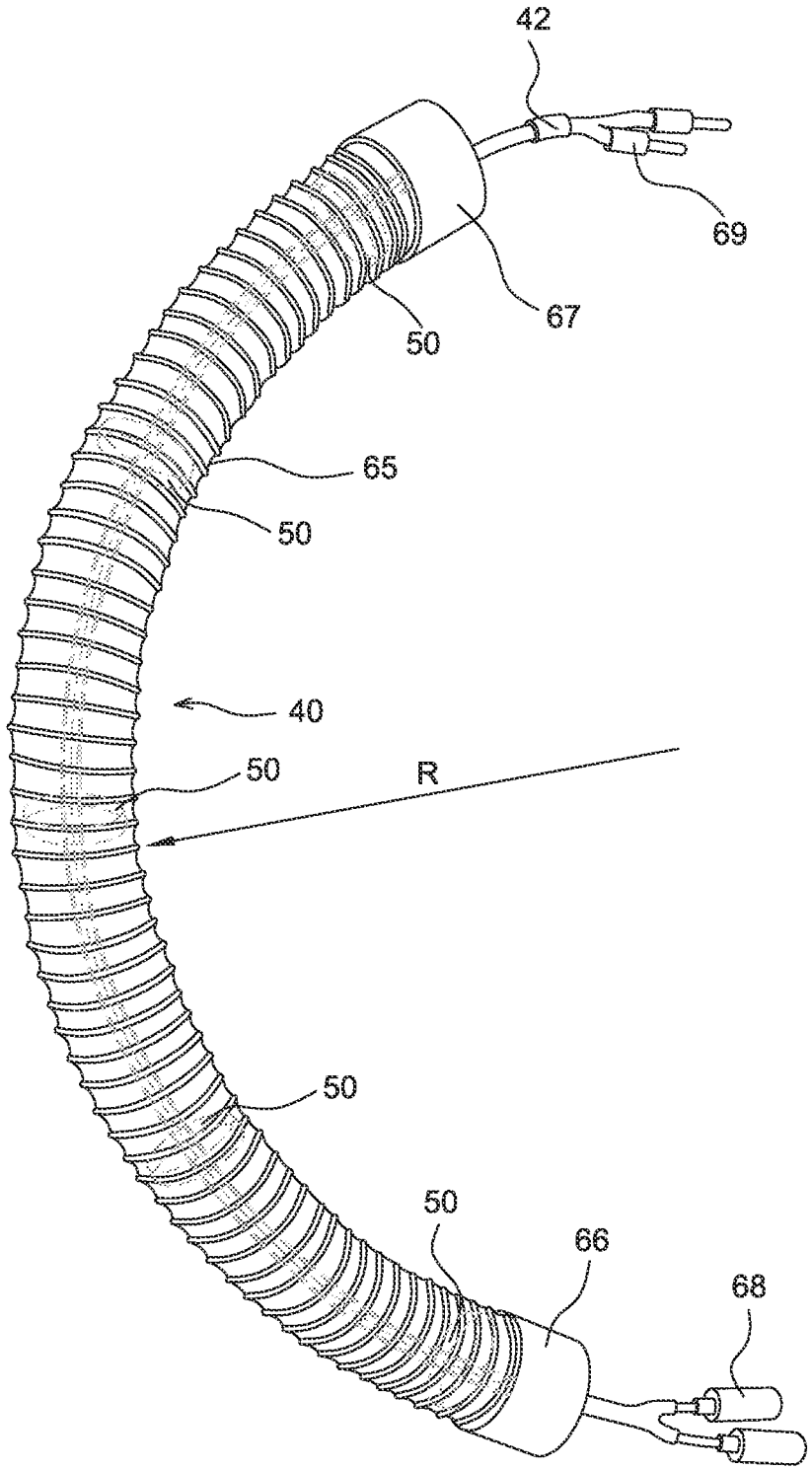
FIG. 5 is a complete view of a variant of the feed bushing device of the invention from FIGS. 3*a* and 4*a*.

FIG. 5 is a complete view of a variant of the feed bushing device of the invention from FIGS. 3*a* and 4*a*.

In this variant from FIG. 5, the polyurethane pipe 40 includes a metal reinforcing armature in its wall 44. This reinforcing armature may be produced, for example, by a flexible metal wire 65 wound helically along the wall 44 to reinforce its resistance to crushing. The metal wire 65 integrated into the wall of the pipe 40 enables the feed bushing device to be curved with smaller radii of curvature R without deforming the circular section of the pipe.

The feed bushing device from FIG. 5 includes at each of its ends a cap 66, 67 for closing the pipe 40. The balanced two-wire line 42 encapsulated in the pipe 40 projects from the caps 66, 67 by a certain length including at one of the ends female banana plugs 68 and at the other end male banana plugs 69 for the connection of the bushing device to other balanced two-wire lines or ports.

Figure 6:
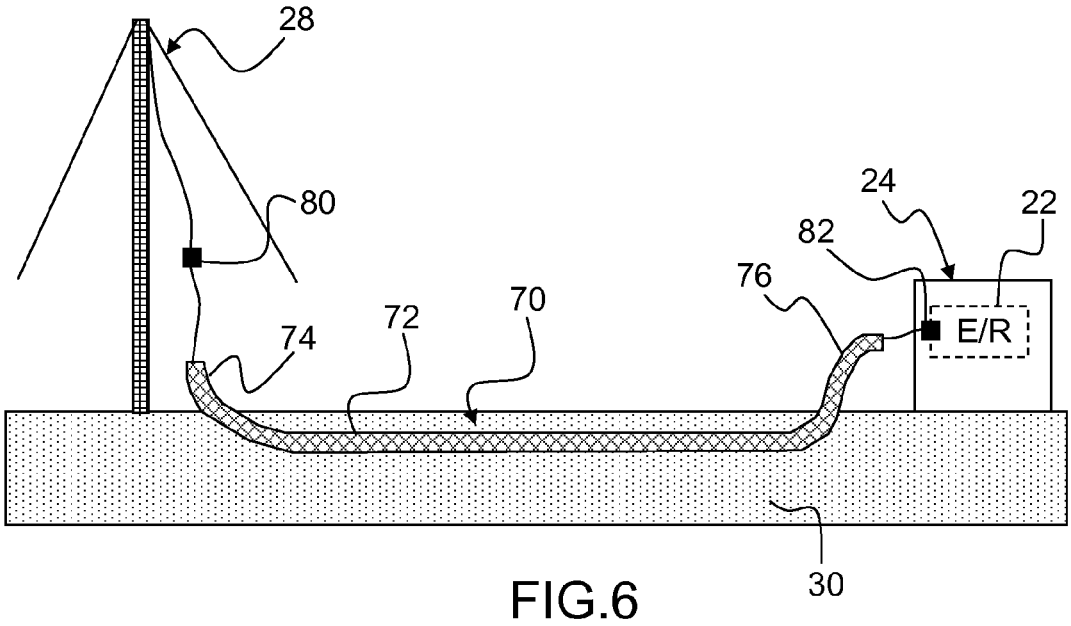
FIG. 6 is a diagram of a first application of the feed bushing device of the invention.

FIG. 6 is a diagram of a first application of the feed bushing device of the invention.

The feed to the antenna 28 from the transmitter/receiver 22 includes a feed bushing device 70 of the invention having a part 72 buried in the ground 30 and two ends 74, 76 emerging from the ground 30. One of the ends of the two-wire line leaving the bushing device 70 is connected to a two-wire input 80 of the antenna 28 and the other end to a two-wire port 82 of the transmitter/receiver 22. In contrast to the prior art embodiment from FIG. 1, no line support 32 is necessary, vegetation presenting no obstacle to the passage of the bushing device, which to a great extent remains invisible.

Figure 7:
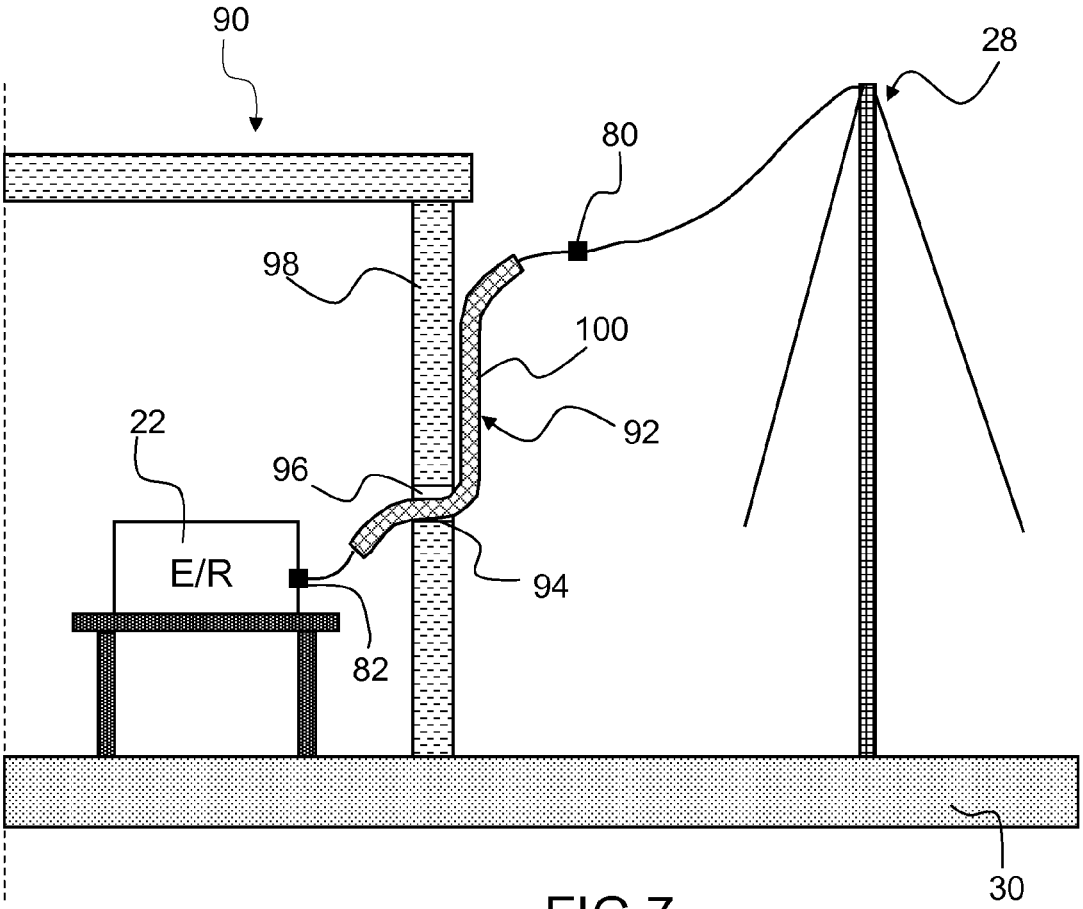
FIG. 7 is a diagram of a second application of the feed bushing device of the invention.

FIG. 7 is a diagram of a second application of the feed bushing device of the invention.

FIG. 7 represents the antenna 28 fed by the transmitter/receiver 22 in a place 90 in the vicinity of the antenna. The feed to the antenna 28 from the transmitter/receiver 22 includes a feed bushing device 92 of the invention having a first part 94 passing through a hole 96 in a wall 98 of the place 90 and a second part 100 pressed against and running along the wall to the antenna 28. The balanced two-wire line of the feed bushing device 92 leaving its protection pipe in the place 90 is connected to the two-wire port 82 of the transmitter/receiver 22, the other end of the two-wire line of the bushing device 92, outside that place, is connected to the two-wire input 80 of the antenna 28.

In this embodiment shown in FIG. 7, the feed bushing device of the invention enables the two-wire line to be passed through a wall. However, the line may also be passed through a door or a window of the place with a small radius of curvature R without modification of the radio-frequency characteristics of the feed two-wire line of the antenna. The place may be an enclosed and air-conditioned place.

The feed bushing device of the invention has the following advantages:

- a low weight, which facilitates its transportation,
- good flexibility enabling adaptation to installation constraints, small radius of curvature R, high crushing stresses, adaptability to installation constraints,
- a length of the feed bushing that may be adapted as required: from 10 centimeters to a few meters,
- watertightness enabling its use in rainy conditions or in moist outdoor environments,
- a small volume (transportability, discretion),
- resistance to crushing and to reduced pressure stresses,
- easy implementation and production,
- non-degraded radio-frequency characteristics (characteristic impedance and losses per unit length) independent of the deformation of the bushing device (radius of curvature) and the surrounding medium.

The invention claimed is:

1. An HF feed bushing device to connect an HF transmitter/receiver to an antenna via an external medium by means of a balanced two-wire line, said device comprising:

a closed conduit including a wall separating the external medium from an internal medium in the closed conduit having dielectric and magnetic permitivity close to that of air and the balanced two-wire line is partially encapsulated in a central part of the closed conduit; and insulative spreaders held in position in the closed conduit by flexible insulative material separators around the balanced two-wire line, wherein the balanced two-wire line is held in the central part of the closed conduit by the insulative spreaders disposed along the two-wire line, wherein the conduit is a flexible and watertight material pipe of circular section to provide flexibility and isolation between the external medium and the internal medium, wherein at least one of the flexible insulative material separators is disposed between two consecutive insulative spreaders to absorb the stresses on the spreaders on curvature of the pipe, and wherein the flexible insulative material separators are helical spirals.

2. The feed bushing device as claimed in claim 1, wherein the closed conduit has two ends and at each of the ends an insulative material cap for closing the conduit to isolate the internal medium from the external medium.

3. The feed bushing device as claimed in claim 1, wherein the pipe includes a metal reinforcing armature in its wall.

4. The feed bushing device as claimed in claim 3, wherein the metal reinforcing armature is a metal wire wound helically along the wall of the pipe to preserve the flexibility properties of the bushing.

5. The feed bushing device as claimed in claim 1, wherein the wall of the pipe is metalized in order to prevent any external radio-frequency influence on the two-wire line.

* * * * *